United States Patent [19]

Reuter et al.

[11] 4,419,260

[45] Dec. 6, 1983

[54] METHOD FOR THE PRODUCTION OF A SUDS-STABILIZED SILICONE-CONTAINING DETERGENT

[75] Inventors: Herbert Reuter, Hilden, Fed. Rep. of Germany; Herbert Saran, deceased, late of Dusseldorf, Fed. Rep. of Germany, by Karin Saran nee Müller, heiress; Martin Witthaus, Dusseldorf, Fed. Rep. of Germany

[73] Assignee: Henkel Kommanditgesellschaft Auf Aktien, Dusseldorf-Holthausen, Fed. Rep. of Germany

[21] Appl. No.: 386,596

[22] Filed: Jun. 9, 1982

[30] Foreign Application Priority Data

Jul. 20, 1981 [DE] Fed. Rep. of Germany ..... 3128631

[51] Int. Cl.[3] ..... C11D 3/12; C11D 9/36; C11D 11/02; C11D 17/00

[52] U.S. Cl. ..... 252/174.13; 106/287.13; 252/173; 252/174.15; 252/174.21; 427/213.3

[58] Field of Search ..... 252/174.13, 174.15, 252/321, 358, 173, 174.18, 174.23, 174.24, 174.21; 556/465; 106/287.13; 427/213.3

[56] References Cited

U.S. PATENT DOCUMENTS

| | | | |
|---|---|---|---|
| 2,676,182 | 4/1954 | Daudt et al. | 556/453 |
| 2,678,893 | 5/1954 | Kauppi | 428/540 |
| 3,235,509 | 2/1966 | Nitzsche et al. | 252/358 |
| 3,629,955 | 12/1971 | Davis | 34/174 |
| 3,829,386 | 8/1974 | Wegst et al. | 252/135 |
| 3,933,672 | 1/1976 | Bartolotta et al. | 252/116 |
| 3,962,119 | 6/1976 | Cosentino et al. | 252/174.15 |
| 4,005,044 | 1/1977 | Raleigh | 252/538 |
| 4,129,511 | 12/1978 | Ogoshi et al. | 252/140 |
| 4,261,793 | 4/1981 | Nakamura et al. | 252/536 |
| 4,264,465 | 4/1981 | Abel | 252/358 |
| 4,274,974 | 6/1981 | Kerkhoven | 252/174.21 X |
| 4,339,342 | 7/1982 | Hempel et al. | 252/174.15 X |
| 4,363,740 | 12/1982 | Curtis et al. | 252/174.13 X |

FOREIGN PATENT DOCUMENTS

| | | |
|---|---|---|
| 1619859 | 7/1970 | Fed. Rep. of Germany . |
| 2345335 | 4/1975 | Fed. Rep. of Germany . |
| 2518053 | 3/1976 | Fed. Rep. of Germany . |
| 2443853 | 4/1976 | Fed. Rep. of Germany . |
| 2534250 | 7/1976 | Fed. Rep. of Germany . |

*Primary Examiner*—John E. Kittle
*Assistant Examiner*—Mukund J. Shah
*Attorney, Agent, or Firm*—Hammond & Littell, Weissenberger and Muserlian

[57] ABSTRACT

In the production of a spray-dried detergent containing a silicone/silica mixture as an antifoaming agent, the aqueous silicone-free detergent slurry (A) is combined in the range of the spray nozzle or in the pressure line leading to the spray nozzle under conditions whereby substantial mixing is avoided in order to avoid loss of the antifoaming action, with an aqueous dispersion (B) which contains the liquid antifoaming silicone agent, which is present in a particle size of from 0.5 to 40 $\mu$m, as well as a film-forming, high-molecular-weight polymer which is soluble or swellable in water, and which is suitable for the formation of microcapsules, preferably a cellulose ether. The microcapsules are formed during the combination of the mixture (A) with the dispersion (B) at the time of spraying, or in the dispersion itself, if electrolyte salts were added to the latter before spraying.

15 Claims, No Drawings

METHOD FOR THE PRODUCTION OF A SUDS-STABILIZED SILICONE-CONTAINING DETERGENT

BACKGROUND OF THE INVENTION

Detergents with a content of suds-stabilizing silicones are known, for example, from DE-OS 20 50 768, corresponding to U.S. Pat. No. 3,829,386, and DE-OS 23 38 468, corresponding to U.S. Pat. No. 3,933,672. These silicones are organopolysiloxanes, such as alkylpolysiloxanes and arylpolysiloxanes, particularly dimethylpolysiloxane, also their copolymers and block-polymers with polyalkylene oxides, especially ethylene oxide, as well as their acylation products with long-chained carboxylic acids. Usually the silicones used as suds-stabilizers contain 0.2% to 10% by weight of highly dispersed silica or highly dispersed aluminum oxide, where the highly dispersed silica is obtained, for example, by thermal dissociation of silicon tetrachloride or by precipitation from silicate solutions and which can be made hydrophobic by the action of silicon-organic compounds.

Normally quantities of 0.1% by weight of a silicone already suffice to make detergents of ordinary composition suds stable for use in drum-type household washing machines. However, considerable technical difficulties are presented to disperse such small quantities homogeneously in a wash powder. If the silicone is dispersed in the aqueous mixture (slurry) provided for hot spray-drying, a substantial part of the suds-stabilizing action is already lost in the subsequent spray drying, so that it is necessary to use a double to four-fold amount of the rather expensive silicone to get the desired result. It has, therefore, been repeatedly suggested to mix the silicones with solid carriers, such as the builder salts or the per compounds, or to embed them in a carrier material and to mix the granular premix obtained with the bulk of the detergent, preferably as a spray-dried hollow sphere powder. This requires, however, a weight-controlled mixing process, which increases the costs. A disadvantage is also that the additional mixing process may lead to a partial destruction of the hollow sphere structures and to increased dust formation.

It has also been suggested to atomize the suds-stabilizing silicone through a separate spray nozzle leading into the spray tower and to obtain this way a uniform distribution of the suds-stabilizer. But it was found that the known organopolysiloxanes can only be atomized to sufficiently small droplets under great difficulties, due to their special surface-active properties. Rather large drops are mostly formed, which lead to a substantially nonhomogeneous distribution and inadequate suds-stability of the detergent. In addition, the silicones come in direct contact with the detergent components, particularly the surfactants, so that the effect of the suds-stabilizers is again partly lost during the subsequent storage of the detergents.

OBJECTS OF THE INVENTION

An object of the present invention is to develop a method for the introduction of suds-stabilizing amounts of silicones into a detergent where the above-noted defects are avoided.

A further object of the present invention is the development of a method for the production of a suds-stabilized silicone-containing detergent by the spray-drying of an aqueous slurry mixture with a content of:

(A) customary tensides, builder salts and other deteregent components which are stable under spray-drying conditions, and (B) suds-stabilizing silicones which comprise jointly passing an aqueous slurry mixture containing components (A) and a separately produced aqueous dispersion containing suds-stabilizing silicones (B), and a film-forming, high-molecular-weight polymer, which is soluble or swellable in water, in an amount sufficient for the formation of microcapsules, said suds-stabilizing silicones being present in said aqueous dispersion in a particle size of from 0.5 μm to 40 μm, through a spray nozzle into an air-heated fall space and recovering said suds-stabilized silicone-containing detergent.

Another object of the present invention is the obtaining of an aqueous dispersion containing suds-stabilizing silicones (B), and a film-forming, high-molecular-weight polymer, which is soluble or swellable in water, in an amount sufficient for the formation of microcapsules, said suds-stabilizing silicones being present in said aqueous dispersion in a particle size of from 0.5 μm to 4 μm.

These and other objects of the present invention will become more apparent as the description thereof proceeds.

DESCRIPTION OF THE INVENTION

The method according to the invention avoids the above-mentioned drawbacks and achieves the above-mentioned objects.

The subject of the invention is a method for the production of a suds-stabilized silicone-containing detergent by spray-drying of an aqueous mixture with a content of (A) conventional tensides, builder salts and other detergent components which are stable under the conditions of spray-drying, and (B) suds-stabilizing silicones, characterized in that the aqueous mixture containing the components (A) and a separately produced aqueous dispersion, which contains the silicones (B) in a particle size of from 0.5 μm to 40 μm, as well as a water-soluble or film-forming, high-molecular-weight polymer swelling in water in an amount sufficient for the formation of microcapsules, are sprayed jointly.

More particularly, the present invention relates to a method for the production of a suds-stabilized silicone-containing detergent by the spray-drying of an aqueous slurry mixture with a content of:

(A) customary tensides, builder salts and other detergent components which are stable under spray-drying conditions, and (B) suds-stabilizing silicones which comprise jointly passing an aqueous slurry mixture containing components (A) and a separately produced aqueous dispersion containing suds-stabilizing silicones (B), and a film-forming, high-molecular-weight polymer, which is soluble or swellable in water, in an amount sufficient for the formation of microcapsules, said suds-stabilizing silicones being present in said aqueous dispersion in a particle size of from 0.5 μm to 40 μm, through a spray nozzle into an air-heated fall space and recovering said suds-stabilized silicone-containing detergent; as well as the aqueous dispersion containing suds-stabilizing silicones (B), and a film-forming, high-molecular-weight polymer, which is soluble or swellable in water, in an amount sufficient for the formation of microcapsules, said suds-stabilizing silicones being present in said aqueous dispersion in a particle size of from 0.5 μm to 40 μm.

The components (A) contained in the aqueous mixture comprise conventional tensides, which can be of an anionic, nonionic, zwitterionic or cationic nature. Suitable anionic tensides are soaps, particularly saturated or mono-unsaturated sodium fatty acid soaps having from 12 to 22 carbon atoms, sulfonates, like $C_8$–$C_{18}$-alkylbenzene sulfonates, particularly sodium dodecylbenzene sulfonate, also $C_8$–$C_{22}$-alkane sulfonates, $C_8$–$C_{22}$-olefin sulfonates, α-sulfo-higher-fatty acids, $C_8$–$C_{22}$-alkylsulfosuccinates and $C_8$–$C_{22}$-alkyl-$C_2$–$C_3$-oxyalkylene ether sulfonates, as well as sulfates, like $C_8$–$C_{22}$-alkyl sulfates, particularly higher fatty alcohol sulfates and higher fatty alcohol $C_2$–$C_3$-alkylene glycol ether sulfates.

Tensides with aliphatic radicals are usually linear or methyl-branched (oxo radicals), contain 10 to 20 carbon atoms, and are present as salts of sodium, potassium, ammonium or organic ammonium bases. Conventional nonionic tensides are particularly alkyl polyethylene glycol or alkenyl polyethylene glycol ethers with linear or methyl-branched $C_{10}$–$C_{20}$-radicals and 3 to 30 glycol ether groups, also glycol ether derivatives with the same number of carbon and glycol ether groups which are derived from alkyl phenols, alkylamines, thioalcohols, fatty acids and fatty acid amides, as well as block polymers of ethylene oxide and propylene oxide, known under the name of "Pluronics." Mixtures of different anionic and/or nonionic tensides can likewise be present.

The components (A) include conventional builder salts, like polymeric phosphates, particularly sodium tripolyphosphate; sodium silicate of the composition:

$$Na_2O:SiO_2 = 1:1 \text{ to } 1:3.5,$$

sodium carbonate, as well as particularly water-insoluble, finely crystalline or amorphous alkali metal aluminosilicates of the formula:

$$(Na_2O)_x.Al_2O_3.(SiO_2)_y$$

with x=0,7 to 1.5, y=1.3 to 4, which contain bound water and have a calcium binding power of at least 50 mg CaO/gm of active substance.

Among the builder salts are the known sequestrants, such as the amino polycarboxylic acids, polyphosphonic acids which may contain hydroxyalkyl or aminoalkyl groups, polycarboxylic acids, ether carboxylic acids, hydroxycarboxylic acids and polymeric carboxylic acids containing hydroxyl-, ether-, or oxo-groups. These acids can be present as salts of sodium, potassium, ammonium or organic ammonium bases. Representatives of these sequestrants are, for example, salts of nitrilo-triacetic acid, ethylenediamino-tetraacetic acid, aminotri-(methylene-phosphonic acid), ethylenediamino-tetraphosphonic acid, 1-hydroxyethane-1,1-diphosphonic acid, methylenediphosphonic acid, ethylene-diphosphonic acid, as well as salts of the higher homologs of the said polyphosphonic acids.

Suitable polycarboxylic acids are citric acid, tartaric acid, benzene hexacarboxylic acid and tetrahydrofuran-tetracarboxylic acid, as well as polycarboxylic acids containing carboxymethylether groups like 2,2'-oxydisuccinic acid, diglycolic acid, triscarboxymethylglycerine and biscarboxymethylglyceric acid.

Suitable representatives of polymeric carboxylic acids are those with a molecular weight of at least 350, such as polyacrylic acid, polymethacrylic acid, poly-α-hydroxyacrylic acid, polymaleic acid, polyitaconic acid, polymesaconic acid, polybutene-tricarboxylic acid, as well as the copolymers of the corresponding monomeric carboxylic acids with each other or with ethylene-unsaturated compounds, like ethylene, propylene, isobutylene and vinyl-methyl ether, also the polycarboxylic acids containing hydroxy and aldehyde groups which can be obtained by polymerization of acrolein and a subsequent Canizzaro reaction.

Other components associated with the substance group (A) are optical brighteners, graying-preventing or anti-redepositing substances, such as carboxymethylcellulose, methyl cellulose or methylhydroxypropyl cellulose, stabilizers, such as magnesium silicate, neutral salts, such as sodium sulfate, powder improvers, such as benzenesulfonate, toluenesulfonate, xylenesulfonate and cumenesulfonate, as well as sodium sulfosuccinate, also dyes.

The above-mentioned compounds associated with component (A) are thus conventional detergent components which are stable under the conditions of hot spray drying, and which are mixed to an aqueous slurry mixture that is still pumpable and sprayable. The water content of such a mixture is generally 50% to 25% by weight, depending on the composition. The aqueous mixture is normally conveyed from the preparing vessel to a high-pressure pump and pumped from there through a pressure line (riser) to the spray nozzles, of which several are mostly arranged in the head of the spray tower and are joined with each other through a ring conduit. In some cases, the aqueous mixture is degassed in a vacuum chamber before it is conducted into the high-pressure unit.

The combination of the aqueous mixture containing the components (A) with the aqueous mixture containing the components (B), which is described more fully below, is effected preferably in an area which comprises the spray nozzles themselves, as well as the top area of the high-pressure line leading to the spray nozzles under conditions whereby substantial mixing is avoided. If the combination is effected in the spray nozzles, the latter consist of binary nozzles provided with separate supply of the two partial currents. With the same result, but less engineering effort, the two partial currents can also be combined in the high-pressure line leading to the spray nozzles, while employing single-component nozzles. In this case, the combination of the two partial currents should be effected preferably close to the spray nozzle or close to the distributor ring conduit to which the circularly arranged spray nozzles are connected. Additional fittings to enhance the homogenization of the two partial currents should be avoided, since this would reduce the effect. This latter is the preferred procedure.

The second aqueous mixture containing the component (B) which is likewise spray-dried, but produced separately from the mixture containing component (A), contains the suds-stabilizing silicones, which are organopolysiloxanes, as mentioned above, in admixture with small amounts of highly dispersed, optionally silanized (rendered hydrophobic) silica or highly dispersed aluminum oxide. Suitable siloxane content of the silicones in the sense of the invention are those organopolysiloxanes which are composed of elements of the formula:

$$\left[\begin{array}{c} R \\ | \\ SiO \\ | \\ R' \end{array}\right]_x$$

where R and R' denote, independent of each other, alkyl groups, preferably having from 1 to 6 carbon atoms, such as methyl, ethyl, propyl, and butyl, $C_{6-8}$-hydrocarbon aryl groups, such as phenyl, and x stands for numbers of from about 20 to 2,000. The end groups are, for example, alkyl or hydroxyl. Particularly suitable are polydimethyl siloxanes which have a viscosity of 20 cSt to 1,500 cSt at 25° C. The above-mentioned organopolysiloxanes, which are liquid at room temperature, can also be present in mixture with known polysiloxane resins, which are obtainable as described for example, in U.S. Pat. Nos. 2,676,182, 2,678,893, or 3,235,509, by reacting alkyl siloxanes wth chlorosilanes or $SiO_2$. Such mixtures are described in DE-AS 16 19 859. Furthermore, self-emulsifying organopolysiloxanes can be used, which consist of block polymers of alkylpolysiloxanes or arylpolysiloxanes and polyglycolether, and which are described in DE-OS 23 45 335, 24 43 853 , 25 18 053 and 25 34 250. The above eight patents and published patent applications are incorporated herein by reference.

The aqueous mixture containing the silicone dispersion also contains a film-forming high-molecular-weight polymer, which is soluble or swellable in water, in an amount which suffices to form microcapsules in which the silicones are substantially enclosed after spray-drying. The weight ratio of silicone to the film-forming polymer is preferably 10:1 to 2:1, and particularly 6:1 to 3:1. The content of silicone in the aqueous mixture should be from 0.2% to 25% by weight, preferably from 5% to 20% by weight, and the content of film-forming polymers should be from 0.2% to 10% by weight, preferably from 1% to 5% by weight.

Particularly suitable as film-forming, high-molecular-weight polymers which are soluble or swellable in water are cellulose ethers, such as carboxymethyl cellulose (as the sodium salt) and methyl cellulose, also hydroxyalkyl celluloses, like hydroxyethyl cellulose, hydroxypropyl cellulose or mixed ethers, like methylhydroxypropyl cellulose and methylcarboxymethyl celulose. Mixtures of different cellulose ethers can also be used with advantage.

Other suitable film-forming, high-molecular-weight polymers are soluble or depolymerized starch, starch ethers, starch esters, also synthetic polymers, such as polyacrylates, polymethacrylates, polyacrylamide, polyvinyl-alcohol or partly saponified polyvinyl acetate, polyvinyl pyrrolidone, polymaleates, as well as copolymers which contain the monomeric elements of the said polymers. Mixtures of the said homopolymers and copolymers are likewise suitable.

In the production of the aqueous dispersion of the silicones, the preferable procedure is to dissolve or swell the polymers first completely and then add the silicones. Suitable mixers, agitators and emulsifying apparatus are employed to ensure that the silicones have a particle or droplet size of 0.5 μm to 40 μm, preferably 1 μm to 20 μm. Such a dispersion is sufficiently stable so that it can be conveyed without substantial separation to the spray-drying plant and sprayed in the above-described manner together with the slurry containing the detergent of component (A).

In another and preferred embodiment, water-soluble electrolyte salts can be added to the aqueous mixture containing the silicones and film-forming, high-molecular-weight polymers, after formation of the fine dispersion of the silicones. The film-forming, high-molecular-weight polymers are thus precipitated partly or completely from their aqueous solution or swollen state so that the microcapsules are already formed in the aqueous mixture. The content of electrolyte salts in the suspension, if present, can amount to from about 1% to 25% by weight, preferably 5% to 20% by weight. Suitable water-soluble electrolyte salts are the alkali metal and magnesium chlorides, sulfates and nitrates especially of sodium, potassium and magnesium, as well as the silicates, phosphates, pyrophosphates and polyphosphates, acetates, lactates and citrates of alkali metals, such as sodium and potassium. Preferably sodium sulfate and sodium phosphates, including the polyphosphates, are used as electrolyte salts. Dispersions in which the silicones are already encapsuled have the advantage that they can be stored for a longer time. Creamed dispersions can be homogenized again by simple stirring. If electrolyte salts are not used, the microcapsules are formed at the moment they come in contact with the aqueous mixture containing components (A).

The amounts of the two partial currents are so regulated by metering that the spray-dried detergent contains 0.02% to 0.4%, preferably 0.05% to 0.2%, and particularly 0.1% to 0.15%, by weight of silicone when leaving the spray tower. These amounts suffice in most cases for effective suds-stabilization. They are clearly below the amount of silicone required if the suds depressors are dispersed directly in the aqueous mixture, which contains the bulk of the detergent components (component A), and then spray dried.

It was very surprising to find that, when the two separately produced mmixtures are combined in the high-pressure line or in the spray nozzle under conditions whereby substantial mixing is avoided, stable microcapsules are formed which prevent the emulsification of the detergent slurry and that the preformed microcapsules can withstand without damage the high drying temperatures generally used in a drying tower. Furthermore, it was found surprisingly that the detergents and the microcapsules contained therein, which are firmly cemented with the detergent particles, are substantially stable in storage, so that there is no great reduction of the suds-inhibiting properties during prolonged storage due to interactions between the silicone and the surfactants and wash-alkalies contained in the detergents.

The following examples are illustrative of the invention without being limitative.

EXAMPLE 1

Two kg of methyl cellulose and 1.7 kg of sodium carboxymethyl cellulose were dissolved under stirring in 85 kg of water of 20° C. in a 110-liter vessel with a propeller stirrer. After one hour of stirring 11.3 kg of silicone oil (Product Y 6067 of Union Carbide and Chemical Co.) were distributed within ten minutes under stirring. The fine emulsification was effected by pumping the contents of the vessel over a pipe loop and through a high speed emulsifying apparatus, which was equipped with several rotor and stator disks. After about 30 minutes, a stationary state had been achieved with a droplet size of 1 μm to 20 μm. The silicone oil emulsion was then passed through a high-pressure pump and fed at a pressure of 52 bar into the pressure line leading to the spray nozzles, and combined with the detergent slurry. The feeding was effected directly before the riser with the aqueous slurry of component (A) passed into the ring conduit leading to the various spray nozzles (single-component nozzles).

The drying tower was charged with air of 230° C. inlet temperature and 87° C. outlet temperature, the air flowing in counterflow and with a torque. The rate of flow of the aqueous mixtures was so regulated that 0.13% by weight of silicone oil were contained in the spray-dired tower powder. After the subsequent mixing in of additional sodium perborate, the content of silicone oil in the read-to-use detergent powder dropped to 0.11% by weight. The finished detergent contained as essential components about 15% by weight of anionic and nonionic tensides, 25% by weight of sodium tripolyphosphate, 24% by weight of sodium aluminosilicate, 4.5% by weight of sodium silicate, 22% by weight of sodium perborate, as well as 4.5% by weight of additional customary detergent components, such as graying inhibitors, sequestrants, optical brighteners, perfumes and sodium sulfate.

The detergents were tested after one week of storage for their sudsing behavior in a conventional drum-type household washing machine with a maximum capacity of 5 kg of dry wash, using 7.5 gm per detergent per liter, and with a filling of 2 kg clean cotton fabric in the temperature range between 30° C. and 95° C. No excessive sudsing or overflowing was observed at any time either with soft water of 6° dH or with hard water of 16° dH.

For comparison, a detergent was employed where the same amount of silicone oil was mixed onto the sodium perborate, which mix was subsequently added to the tower powder. The quantitative ratios were so selected that the content of silicone oil in the finished detergent was likewise 0.11% by weight. While the sudsing behavior of the two detergents to be compared with each other was the same after storage for 24 hours, it was found after storage for seven days that the effect of the mixed-up comparison sample had clearly diminished, compared to the sample of the invention, that is, the detergents according to the invention proved superior in their constant action to the known detergents.

EXAMPLE 2

Example 1 was repeated, but the partial streams were not combined in the pressure line, but fed as separate partial streams to the feed lines of a binary nozzle. As far as the sudsing properties are concerned, the detergent proved to be equivalent to those of Example 1.

EXAMPLE 3

As described in Example 1, 1.52 kg of methyl cellulose and 1.16 kg of Na-carboxymethyl cellulose were dissolved under stirring in 73.32 kg of water, and after one hour, 10 kg of silicone oil was added. After obtaining a fine dispersion (droplet size 1 μm to 20 μm), 14 kg of anhydrous sodium sulfate were added in portions within 20 minutes under stirring. A part of the cellulose ether was precipitated and formed stable microcapsules. The capsule suspension was fed into the high-pressure line leading to the single-component nozzles, as described in Example 1. The quantities were so metered that the content of silicone in the detergent after spray drying and after the addition of 20% by weight of sodium perborate, was 0.1% by weight. The detergents obtained proved suds-stable under test and practical conditions.

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. A method for the production of a suds-stabilized silicone-containing detergent by the spray-drying of an aqueous slurry mixture with a content of:

(A) customary tensides, builder salts and other detergent components which are stable under spray-drying conditions, and (B) suds-stabilizing silicones which method comprises jointly passing an aqueous slurry mixture containing components (A) and a separately produced aqueous dispersion containing suds-stabilizing silicones (B), and a film-forming, high-molecular-weight polymer, which is soluble or swellable in water, in an amount sufficient for the formation of microcapsules, said suds-stabilizing silicones being present in said aqueous dispersion in a particle size of from 0.5 μm to 40 μm, through a spray nozzle into an air-heated fall space and recovering said suds-stabilized silicone-containing detergent.

2. The method of claim 1 wherein said aqueous slurry mixture containing the components (A) and said separately produced aqueous dispersion containing the component (B) are combined with each other in an area which comprises the spray nozzles and the high-pressure line leading to the spray nozzles.

3. The method of claim 1 or 2 wherein said aqueous slurry mixture containing the components (A) and said separately produced aqueous dispersion containing the components (B) are fed separately to one of the two feed lines of a binary nozzle and are sprayed jointly.

4. The method of claim 1 or 2 wherein said aqueous slurry mixture containing the components (A) and said separately produced aqueous dispersion containing the the components (B) are combined in the pressure line leading to the spray nozzles and are sprayed jointly.

5. The method of claim 1 or 2 wherein the weight ratio of silicone to film-forming, high-molecular-weight polymer in said aqueous dispersion containing the components (B) is from 10:1 to 2:1.

6. The method of claim 5 wherein said weight ratio is from 6:1 to 3:1.

7. The method of claim 1 or 2 wherein the amount of silicone is from 2% to 25% by weight and the amount of film-forming, high-molecular-weight polymer is from 0.2% to 10% in said aqueous dispersion containing the components (B).

8. The method of claim 7 wherein the amount of said silicone is from 5% to 20% by weight and the amount of said polymer is from 1% to 5% by weight.

9. The method of claim 1 or 2 wherein said film-forming, high-molecular-weight polymer is at least one cellulose ether.

10. The method of claim 9 wherein said cellulose ether is selected from the group consisting of carboxymethyl cellulose, methyl cellulose and mixtures thereof.

11. The method of claim 1 or 2 wherein said suds-stabilizing silicones are present in said aqueous dispersion in a particle size of from 1 μm to 20 μm.

12. The method of claim 1 or 2 wherein said aqueous dispersion containing the components (B) has a further content of from 1% up to 25% by weight of an electrolyte salt which was added after said particle size was attained.

13. The method of claim 12 wherein said electrolyte is present in an amount of from 5% to 20% by weight and is selected from the group consisting of sodium sulfates, sodium phosphates, sodium polyphosphates and mixtures thereof.

14. The method of claim 1 or 2 wherein said suds-stabilized silicone-containing detergent contains from 0.02% to 0.4% by weight in the spray-dried detergent of said suds-stabilizing silicones.

15. The method of claim 1 or 2 wherein said suds-stabilized silicone-containing detergent contains from 0.05% to 0.2% by weight in the spray-dried detergent of said suds-stabilizing silicones.

* * * * *